US006312564B1

(12) United States Patent
Grabscheid et al.

(10) Patent No.: US 6,312,564 B1
(45) Date of Patent: Nov. 6, 2001

(54) SEALING DEVICE AND PROCESS FOR SEALING PRESSURE ZONES IN A PAPER-MAKING MACHINE

(75) Inventors: Joachim Grabscheid, Gerstetten; Karl Josef Böck; Hans Prinzing, both of Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/398,140

(22) Filed: Sep. 17, 1999

(30) Foreign Application Priority Data

Sep. 18, 1998 (DE) ..... 198 42 837

(51) Int. Cl.[7] ..... D21F 3/10

(52) U.S. Cl. ..... 162/371; 162/369; 162/371; 277/300

(58) Field of Search ..... 162/199, 217, 162/272, 278, 279, 297, 306, 310, 335, 351, 358.1, 358.3, 358.5, 359.1, 363, 364, 365, 366, 367, 368, 369, 370, 371, 372, 373, 374; 226/95; 277/300, 345, 906, 306, 358; 492/20

(56) References Cited

U.S. PATENT DOCUMENTS

| | | | | |
|---|---|---|---|---|
| 2,969,837 | | 1/1961 | Reynar | 162/371 |
| 3,802,961 | * | 4/1974 | Grass et al. | 162/371 |
| 4,714,523 | * | 12/1987 | Sawyer, Jr. et al. | 162/371 |
| 5,580,424 | * | 12/1996 | Snellman | 162/371 |
| 5,975,532 | * | 11/1999 | Karttunen et al. | 277/300 |

FOREIGN PATENT DOCUMENTS

| | | | |
|---|---|---|---|
| 542982 | 2/1932 | (DE) | D21F/3/10 |
| 97/17490 | 5/1997 | (WO) | D21F/3/10 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

A sealing device and process for laterally sealing at least one overpressure zone or underpressure zone adjacent to an actuating surface in a paper-making machine. The sealing device has at least one sealing element arranged movably at least locally in an intake area of a support. The sealing element is loaded with a sealing or opposing force in order to place it against the actuating surface. A stopping element is fixed at a distance from the actuating surface which limits the seating motion of the sealing element.

29 Claims, 3 Drawing Sheets

SEALING DEVICE AND PROCESS FOR SEALING PRESSURE ZONES IN A PAPER-MAKING MACHINE

CROSS-REFERENCE TO RELATED APPLICATIONS

The present application claims priority under 35 U.S.C. §119 of German Application No. 198 42 837.5, filed on Sep. 18, 1998, the disclosure of which is expressly incorporated by reference herein in its entirety.

BACKGROUND OF THE INVENTION

1. Field of the Invention

The present invention relates to a sealing device for the lateral sealing of at least one overpressure zone or underpressure zone adjacent to an actuating surface in a paper machine. The sealing device includes at least one sealing element that is arranged for movement at least locally in an intake area of a support. The sealing element can be loaded with an opposing (sealing) force in order to move it against the actuating surface.

Such sealing devices and processes serve the purpose, for example, of sealing off from their surroundings, the interior of a suction box, whose side walls are provided with the sealing device, under an underpressure. The sealing elements are pressed against a rotating jacket of a suction roll, over which a paper web to be dewatered is guided, in such a way that the sealing element is optimally situated adjacent to the jacket and a good sealing effect is achieved.

2. Discussion of Background Information

U.S. Pat. No. 5,580,424 discloses a sealing element arranged in an intermediate support, which is in turn mounted in a support. The sealing element can be moved relative to the support against a roll jacket by way of pressure tubes that can be pressurized, in order to pass the sealing element against the roll jacket. After the intermediate support has been moved into its forward position, the intermediate support is gripped in the support and then the pressure in the pressure tubes is reduced. By means of a spring supported on the intermediate support, the sealing element is biased in the direction of the roll jacket with one shoulder against a stop provided on the intermediate support. With the intermediate support gripped in its forward position, the sealing element can be moved against the prestressing of the spring relative to the intermediate support, in order to compensate for vibrations in the roll jacket.

SUMMARY OF THE INVENTION

The invention, more particularly described below, includes a sealing device for lateral sealing of at least one overpressure or underpressure zone adjacent to an actuating surface in a paper machine. The sealing device comprises at least one sealing element for movement at least locally in an intake area of a support. The sealing element is loadable with an opposing or sealing force to place it against the actuating surface. A stopping element, which can be fixed or locked a certain distance from the actuating surface, limits the seating motion of the sealing element.

The sealing element is movable relative to the stopping element and to the support against the opposing or sealing force.

The stopping element comprises a catching section for engaging in an undercut of the sealing element, the sealing element being movable relative to the catching section between two support surfaces adjacent to the undercut. The stopping element can be firmly coupled with the support to prevent its movement. Alternatively, the stopping element can be pressed against the support to prevent its movement. Furthermore, the stopping element can particularly be gripped between the support and a gripping member. The gripping member comprises a gripping pressure tube arranged between the sealing element and a groove constructed in a bracket for the support.

The sealing device further comprises a piston that can move in the groove and arranged between the gripping pressure tube and the stopping element. The stopping element is movable relative to the support against a return force, the sealing element exerting an opposing force on the stopping element. The opposing force is exerted by a stopping surface on the sealing element. The stopping element is coupled with a bracket on the support by way of an elastically deformable return element, which can be a pressure spring, or a tension spring. The sealing element is moved against the actuating surface by at least one opposing pressure tube arranged between the sealing element and a boundary surface of the intake area facing away from the actuating surface.

A wearing or bearing section is provided on the sealing element for cooperating with the actuating surface. The wearing section comprises a layer, whose material is different from the material of the rest of the sealing element, e.g., a plastic material including high content graphite. The sealing element includes a sealing strip extending at least across the entire roll length.

The sealing device is adapted for laterally sealing at least one pressure zone adjacent to the inner wall, or the outer wall, of a rotating jacket of one of, a suction roll, a blast roll, or an actuating belt. The sealing device may be adapted for use between a suction or blast box and the rotating jacket of one of, a suction roll, a blast roll, or an actuating belt.

A pressure actuator exerts an adjustable sealing force placing the sealing element against the actuating surface. The pressure actuator is in direct contact with the sealing element. The stop element limits the motion of the sealing element towards the actuating surface. The locking mechanism locks the stop element in a desired position. The sealing element is movable relative to the stop element and to the support against the sealing force. The catching section on the stop element engages first and second support surfaces on the sealing element to limit movement of the sealing element towards and away from the actuating surface, so that engagement of the catching section with the first and second support surfaces will define the limits of motion of the sealing element relative to the stop element. The catching section on the stop element slides in a groove of the sealing element between the two support surfaces.

Another feature of the invention resides in having a paper making machine comprise a rotating jacket of one of a suction roll, a blast roll, or an actuating belt and at least one pressure zone adjacent to the inner or outer wall of the rotating jacket. The machine has an actuating surface and a sealing device, including at least one sealing element for laterally sealing at least one pressure zone.

In accordance with yet another aspect of the invention, there is described herein a process for laterally sealing at least one overpressure or underpressure zone adjacent to an actuating surface in a paper making machine. The process comprises moving at least one sealing element locally in an intake area of a support. An adjustable sealing force is exerted, placing the sealing element against the actuating surface by way of a pressure actuator, the pressure actuator being in direct contact with the sealing element. Locking the stop element, by way of a stop element, in a desired position, limits the motion of the sealing element towards the actuating surface.

According to a first embodiment of the invention, a fluid pressure source supplies fluid to the pressure gripping tube and the pressure actuator by way of separate fluid pressure controllers so as to provide different pressure levels thereto.

Alternatively, a single fluid pressure controller may be used in the connection from the fluid pressure source to the gripping pressure tube and pressure actuator, so as to provide the same pressure level to both.

Other exemplary embodiments and advantages of the present invention may be ascertained by reviewing the present disclosure and the accompanying drawing.

BRIEF DESCRIPTION OF THE DRAWINGS

The invention is described below with reference to the drawings.

DETAILED DESCRIPTION OF THE PRESENT INVENTION

Figure 1:
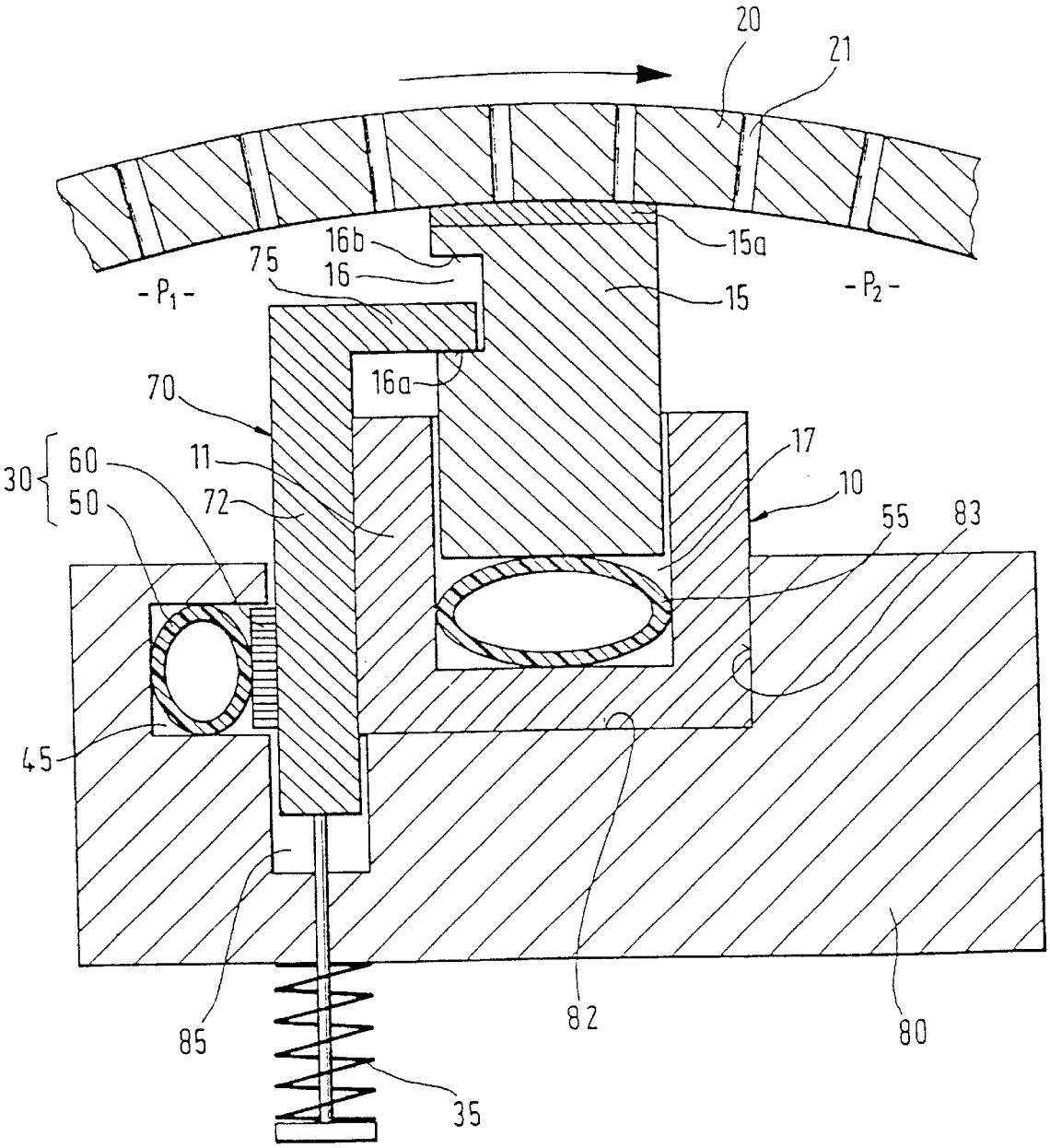
FIG. 1 illustrates a side view of the sealing device according to an exemplary embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawing making apparent to those skilled in the art how the several forms of the present invention may be embodied in practice.

The invention relates to a sealing device of the type mentioned above with which the wear and tear of the sealing element can be simply minimized and an optimal sealing effect can be achieved.

This is attained, particularly, by providing a stopping element which can be fixed a certain distance from the actuating surface and which limits the seating motion of the sealing element.

Providing a stopping element according to the invention makes it possible to limit the distance between the sealing element and the actuating surface to a minimal value independent of the size of the opposing force. Therefore, the sealing element can be pressed against the actuating surface with a predetermined opposing pressure or seated against the actuating surface in such a way that a minimal sealing gap is present that ensures a sufficient seal.

The sealing element can be moved in a first direction by an opposing (sealing) force that can in principle be of any degree without leading to an excessive high surface pressure above the amount necessary to fulfill the sealing function. As a result, the wear and tear on the sealing element can be limited without impairing the sealing function, by carefully controlling the stopping element.

Furthermore, the invention allows the opposing force with which the sealing element is loaded to be maintained during operation, i.e., when the sealing element is seated against the actuating surface. In this way, an elastic seating of the sealing element is obtained. Additionally, vibrations of the actuating surface that would cause increased wear and tear of a sealing element arranged stationarily relative to the support, can be kept at a minimum.

Because of the stopping element provided according to the invention, the opposing force can be adjusted to the necessary value dependent upon the expected range of the vibrations without fear of an increased opposing pressure leading to unacceptable wear and tear on the sealing element.

The sealing device shown in FIG. 1 includes a bracket 80, which is arranged stationarily in a radial direction relative to the partially shown jacket 20 of a suction roll.

The bracket 80 can be attached to a suction box or embodied as part of the suction box, whose interior includes a pressure zone $P_1$. Pressure zone $P_1$ is to be sealed off from its surroundings, e.g., a higher pressure zone $P_2$, by way of a sealing device according to the invention. Higher pressure zone $P_2$ can be provided, e.g., to force moisture through bores 21 provided in jacket 20 and out of a paper web (not shown) to be de-watered. The paper web is guided over the suction roll. Jacket 20, which rotates in the direction of the arrow during operation, provides an actuating surface. In principle, surrounding pressure zone $P_2$ can also be less than pressure $P_1$ inside the suction box, especially when the sealing device according to the invention is used in connection with a blast or blow roll assigned to a blast or blow box.

The suction box extends at least essentially over the entire length of the suction roll and is provided with another sealing device according to the invention (not shown), which is arranged at a distance in the circumferential direction from the sealing device shown in the figure.

In an indentation 83 of the bracket 80, a support 10 is arranged, which has a U-shaped cross-section in a plane perpendicular to the rotational axis of the suction roll and which provides an intake channel 17 that is open to the jacket 20. The support 10 and the bracket 80 are frictionally connected to one another. It is also possible to provide the support 10 and the bracket 80 in the form of a one-piece component.

The intake channel 17 of the support 10, which also extends approximately over the entire length of the roll, forms an intake area 17 for a sealing element 15, which is embodied as a seal that also extends over approximately the entire length of the roll. The sealing element 15 can be moved in the intake channel 17 in a radial direction relative to the support 10.

The face of the sealing element 15 facing the jacket 20 is provided with a wearing coat or bearing surface 15*a,* which is made of a different material than the rest of the sealing element 15, e.g., a plastic material including high content graphite.

Between the face of the sealing element 15 facing away from the jacket 20 and the bottom of the intake channel 17, an opposing or sealing pressure tube 55 is arranged, which also extends over approximately the entire length of the suction roll along the support 10. The opposing pressure tube 55 can be connected to a fluid pressure source P and a valve, by means of which the fluid pressure inside the opposing pressure tube 55 can be adjusted, or varied.

In the case of an increase in pressure, the opposing pressure tube 55 expands, exerting an opposing force on the sealing element 15, moving the sealing element 15 in the direction of the jacket 20.

To the side of the support 10, a stopping element 70 is arranged inside the suction box, which element also extends approximately over the entire length of the roll and which has a section 72 running in an approximately radial direction and a catching section 75 extending perpendicularly to the section 72. As a result, the stopping element 70 has an L-shaped cross-section in a plane perpendicular to the rotational axis of the suction roll.

The stopping element 70 is arranged with its section 72 in an indentation 85 of the bracket 80, whose boundary wall nearest to the outer pressure zone $P_2$ is located approximately in the same plane as the inner surface of the left side wall 11 in the figure of the support 10 facing the pressure zone $P_1$. The stopping element 70 rests with its section 72 against the side wall 11 of the support 10 or at least runs immediately adjacent to the side wall 11.

With its catching section 75, the stopping element 70 catches in a groove 16 that is open to pressure zone $P_1$ and constructed in the sealing element 15. The radial width of the groove 16 is greater than the radial width of the catching section 75 of the stopping element 70 projecting into the groove 16.

In this way, the stopping element 70 grips from behind a radially interior boundary surface of the groove 16 that forms an undercut in relation to the radial direction, where this boundary surface serves as a radially interior stopping face 16*a* that cooperates with the stopping element 70. The boundary surface of the groove 16 facing the jacket 20 and placed at a distance from the catching section 75, in the state shown in the figure, forms a radially exterior stopping face 16*b* of the sealing element 15 for the stopping element 70.

A gripping member 30 is arranged in a groove 45 of the bracket 80 that is open to the stopping element 70 whose radially interior boundary surface is located in the same plane as a support surface 82 of the indentation 83 for the support 10.

The gripping member 30 includes a gripping pressure tube 50 that extends essentially over the entire length of the roll, with which a strip-shaped piston 60 can be loaded that extends along the gripping pressure tube 50. This piston 60 is arranged between the gripping pressure tube 50 and the section 72 of the stopping element 70 and can be moved in the groove 45.

Figure 2A:
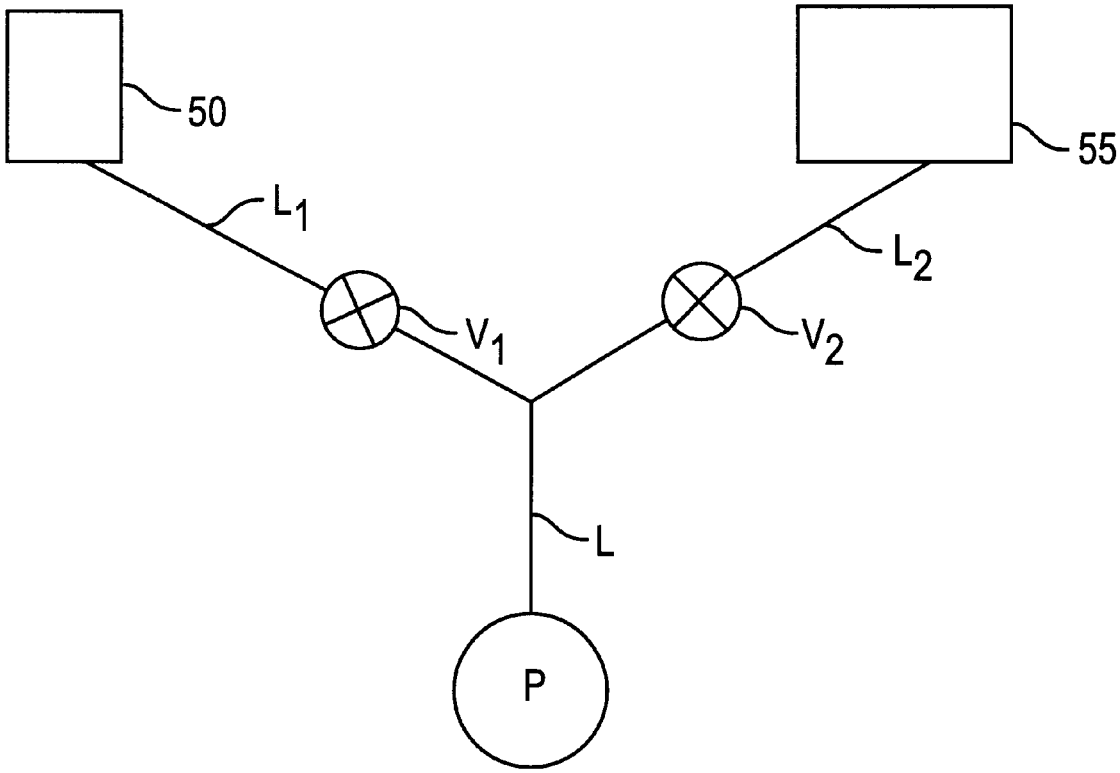
FIG. 2A shows a first embodiment for controlling fluid pressure in a sealing device.
Figure 2B:
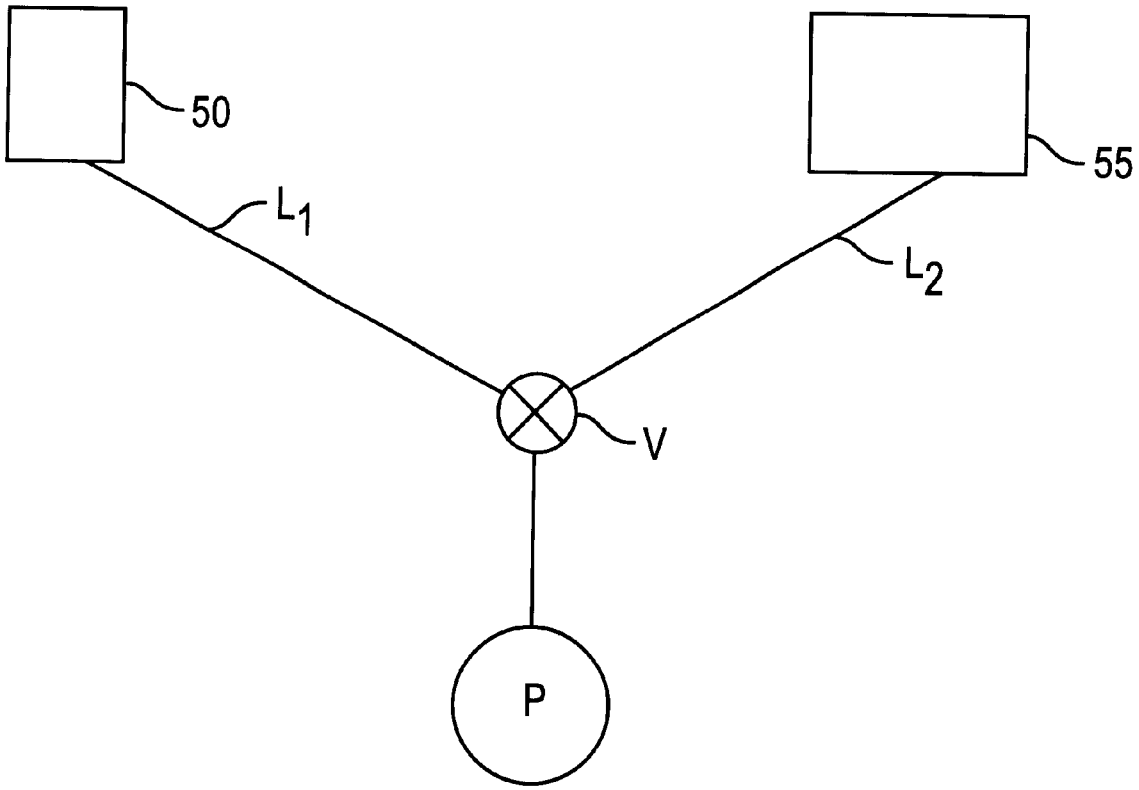
FIG. 2B shows a second embodiment for controlling fluid pressure in a sealing device.

As shown in FIG. 2B, the gripping pressure tube 50 and the opposing pressure tube 55 can be connected to a joint fluid pressure circulation, with a single valve V controlling pressure from pump P in conduit L1, feeding gripping pressure tube 50. The same valve V feeds through conduit L2 opposing pressure tube 55. In this embodiment, the area on which gripping pressure tube 50 acts, i.e., piston 60 and section 72, is much larger than the area on which opposing pressure tube 55 acts, i.e., sealing element 15, so as to compensate for the limited friction coefficient between piston 60 and section 72.

As shown in FIG. 2A, it is also possible to assign a separate fluid pressure source to the gripping pressure tube 50, which source can be operated independently of that of the opposing pressure tube 55. In this embodiment, pump P feeds gripping pressure tube 50 through line L and a first conduit L1 through valve V1, and opposing pressure tube 55 through line L and a second conduit L2 through valve V2. In this embodiment, the pressure level in conduit L1 is higher than that in conduit L2 so as to have a coefficient of friction between piston 60 and section 72 of $\mu<0.2$.

When fluid pressure in the griping pressure tube 50 is increased, the piston 60 moves in the direction of the support 10, until the section 72 of the stopping element 70 is gripped between the piston 60 and the left side wall 11 of the support 10, as viewed in the figure, with a gripping force that is dependent upon the fluid pressure in the interior of the gripping pressure tube 50.

On its free end away from the jacket 20, the section 72 of the stopping element 70 is coupled with a return element 35 in the form of a pressure spring, that is pressed together when the stopping element 70 is moved in the direction of the jacket 20. The return element 35 could, with a correspondingly modified arrangement, also be constructed as a tension spring.

The sealing device according to the invention operates as follows:

In order to press the sealing element 15 against the jacket 20, the opposing or sealing pressure tube 55 is placed under an adjustable pressure. The sealing element 15 is moved relative to the support 10 towards the jacket 20, carrying along with its radially interior stopping surface 16*a,* the stopping element 70 on its catching section 75 against the return force of the return element 35.

When the desired sealing position of the sealing element 15, which is dependent upon the pressure in the opposing pressure tube 55, is obtained, the gripping pressure tube 50 is placed under pressure causing the stopping element 70 to be gripped between the bracket 80 and the support 10 at a distance from the jacket 20 corresponding to the sealing position of the sealing element 15.

The gripping force exerted by the gripping member 30, i.e., the gripping force exerted by the gripping pressure tube 50 by way of the piston 60 on the stopping element 70, is proportioned in such a way that the sealing element 15 cannot be moved further towards the jacket 20 even in case of an increase in opposing pressure supplied by way of the opposing pressure tube 55.

Therefore, when the stopping element 70 is locked in place, an increase in fluid pressure inside the opposing pressure tube 55 does not cause an increase in surface pressure or opposing pressure between the sealing element 15 and the jacket 20 so that excessive wear and tear on the sealing element 15, i.e., an excessive erosion of the wearing coat 15*a,* is prevented.

Vibrations or other movements of the jacket 20 that are transferred to the sealing element 15 also do not lead to an increase in opposing pressure because the sealing element 15 is movable against the opposing pressure. The opposing pressure continues to be exerted on the sealing element relative to the stopping element 70 and the support 10 because of the intermediate space between the radially exterior stopping face 16*b* and the catching section 75 of the stopping element 70.

In connection with the gripped locking of the stopping element 70, the fluid pressure inside the opposing pressure tube 55 can also be reduced by a certain amount such that it is ensured that the sealing element 15 is still held without play between the opposing pressure tube 55 and the stopping element 70 in order to fulfill its sealing function.

As a result, the sealing element 15 is spring mounted in any case because of the opposing pressure tube 55, which is under pressure. Therefore, movements that are transferred by way of the jacket 20 to the sealing element 15 are caught by the sealing device according to the invention such that the wear and tear on the sealing element 15, i.e., the erosion of wearing coat, or bearing section, 15*a,* is minimized.

When operation comes to an end or when operation is interrupted, the fluid pressure in opposing pressure tube 55 and in gripping pressure tube 50 is reduced, the return element 35 ensures that the stopping element 70 is pulled back into its indentation 35, at which point the sealing element 15 can be driven by way of its catching section 75.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

10 support
11 side wall
15 sealing element
15*a* bearing surface, wearing coat
16 undercut, groove
16*a* stopping faces
17 intake area, intake channel
20 actuating surface, jacket
21 bores
30 gripping element
35 return element
45 groove
50 gripping pressure tube
55 opposing pressure tube
60 piston
70 stopping element
72 section of the stopping element
75 catching section of the stopping element
80 bracket
82 support surface
83 indentation for the support
85 indentation for the stopping element
L, L1, L2 conduits
P pump
$P_1$, $P_2$ pressure zones
V, V1, V2 valves

What is claimed is:

1. A sealing device for laterally sealing at least one overpressure or underpressure zone adjacent to an actuating surface in a paper-making machine, the sealing device comprising:

at least one sealing element for movement at least locally in an intake area of a support;

the sealing element being loaded with an opposing force in order to move it against the actuating surface; and a stopping element, which can be fixed a certain distance from the actuating surface, for limiting motion of the sealing element against the actuating surface, wherein the sealing element is movable relative to the stopping element and to the support against the opposing force, and wherein the stopping element comprises a catching section for engaging in an undercut of the sealing element, the sealing element being movable relative to the catching section between two support surfaces adjacent to the undercut.

2. The sealing device recited in claim 1, wherein the stopping element is firmly coupled with the support to prevent its movement.

3. The sealing device recited in claim 1, wherein the stopping element is pressed against the support to prevent its movement, and can be gripped between the support and a gripping member.

4. The sealing device recited in claim 3, further comprising a groove constructed in a bracket for the support, wherein the gripping member comprises a gripping pressure tube arranged between the sealing element and said groove.

5. The sealing device recited in claim 4, further comprising a piston movable in the groove and arranged between the gripping pressure tube and the stopping element.

6. A sealing device for laterally sealing at least one overpressure or underpressure zone adjacent to an actuating surface in a paper-making machine, the sealing device comprising:

at least one sealing element for movement at least locally in an intake area of a support;

the sealing element being loaded with an opposing force in order to move it against the actuating surface; and a stopping element, which can be fixed a certain distance from the actuating surface, for limiting motion of the sealing element against the actuating surface, wherein the stopping element is coupled with a bracket on the support by way of an elastically deformable return element, and wherein the elastically deformable return element comprises a pressure spring.

7. A sealing device for laterally sealing at least one overpressure or underpressure zone adjacent to an actuating surface in a paper-making machine, the sealing device comprising:

at least one sealing element positioned for movement locally in an intake area of a support;

a pressure actuator for exerting an adjustable sealing force moving the sealing element against the actuating surface;

a stop element for limiting the motion of the sealing element towards the actuating surface, wherein the sealing element is movable relative to the stop element and to the support against the sealing force;

a lock for locking the stop element in a desired position; and a catching section on the stop element for engaging first and second support surfaces on the sealing element to limit movement of the sealing element towards and away from the actuating surface, wherein engagement of the catching section with the first and second support surfaces defines the limits of motion of the sealing element relative to the stop element.

8. The sealing device recited in claim 7, wherein the catching section on the stop element slides in a groove of the sealing element between the two support surfaces.

9. The sealing device recited in claim 7, wherein the stop element is firmly coupled with the support to prevent movement of the stop element.

10. The sealing device recited in claim 9, further comprising a gripping member for pressing the stop element against the support to prevent movement of the stop element.

11. The sealing device recited in claim 10, wherein the gripping member comprises a gripping pressure tube arranged between the sealing element and a bracket for the support.

12. The sealing device recited in claim 11, further comprising a groove constructed in the bracket, the gripping tube being positioned in said groove.

13. The sealing device recited in claim 12, further comprising a piston movable in the groove between the gripping pressure tube and the stopping element.

14. The sealing device recited in claim 11, further comprising:

a fluid pressure source;

a first fluid pressure controller for controlling the pressure in the gripping pressure tube; and a second fluid pressure controller for controlling the pressure in the pressure actuator.

15. The sealing device recited in claim 11, further comprising:

a fluid pressure source; and a fluid pressure controller for controlling the pressure in the gripping pressure tube and the pressure actuator.

16. The sealing device recited in claim 7, further comprising a return mechanism for the stop element, the stop element being driven by way of a stop surface of the sealing element loaded with the sealing force, relative to the support, against a return force exerted by the return mechanism.

17. The sealing device recited in claim 16, wherein the return mechanism comprises a pressure spring.

18. The sealing device recited in claim 16, wherein the return mechanism comprises a tension spring.

19. A sealing device for laterally sealing at least one overpressure or underpressure zone adjacent to an actuating surface in a paper-making machine, the sealing device comprising:

at least one sealing element positioned for movement locally in an intake area of a support;

a pressure actuator for exerting an adjustable sealing force moving the sealing element against the actuating surface;

a stop element for limiting the motion of the sealing element towards the actuating surface;

a lock for locking the stop element in a desired position; and a bearing section on the sealing element for cooperating with the actuating surface.

20. The sealing device recited in claim 19, wherein the bearing section comprises a layer made of a material which is different from the material of the rest of the sealing element.

21. The sealing device recited in claim 20, wherein the wearing section comprises a plastic material.

22. The sealing device recited in claim 21, wherein the plastic material further includes graphite.

23. A process for laterally sealing at least one overpressure or underpressure zone adjacent to an actuating surface in a paper-making machine, the process comprising:

moving at least one sealing element locally in an intake area of a support;

exerting an adjustable sealing force on the sealing element for moving the sealing element against the actuating surface;

limiting the motion of the sealing element towards the actuating surface;

locking the stop element in a desired position; and limiting the movement of the sealing element towards and away from the actuating surface between first and second support surfaces defining the limits of motion of the sealing element relative to the stop element.

24. The process recited in claim 23, further comprising sliding the catching section on the stop element in a groove of the sealing element between the two support surfaces.

25. The process recited in claim 24, further comprising firmly coupling the stop element with the support to prevent movement of the stop element.

26. The process device recited in claim 25, further comprising pressing the stop element against the support to prevent movement of the stop element.

27. The process recited in claim 26, further comprising applying a gripping pressure between the sealing element and a bracket for the support.

28. The process recited in claim 27, further comprising moving a piston against the stopping element.

29. The process recited in claim 28, further comprising applying a returning force to the stop element.

* * * * *